US010093015B2

(12) United States Patent
Bolivar

(10) Patent No.: US 10,093,015 B2
(45) **Date of Patent: *Oct. 9, 2018**

(54) WRENCH EXTENSION TOOL

(71) Applicant: Carlos Bolivar, Gilbert, AZ (US)

(72) Inventor: Carlos Bolivar, Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/148,178

(22) Filed: May 6, 2016

(65) Prior Publication Data

US 2016/0325427 A1 Nov. 10, 2016

Related U.S. Application Data

(63) Continuation-in-part of application No. 14/545,471, filed on May 8, 2015, now Pat. No. 9,873,194.

(51) Int. Cl.

| | |
|---|---|
| ***B25G 1/04*** | (2006.01) |
| ***B25B 23/16*** | (2006.01) |
| ***B25G 1/00*** | (2006.01) |
| ***B25B 13/08*** | (2006.01) |

(52) U.S. Cl.

CPC ..... *B25G 1/005* (2013.01); *B25B 13/08* (2013.01)

(58) Field of Classification Search

CPC ..... B25G 1/005; B25G 1/043; B25G 3/24; B25G 1/06; B21F 1/002

USPC ..... 81/177.2, 125.1, 177.25; 16/429, 427, 16/426; 254/29 R, 130, 19, 21, 25

See application file for complete search history.

(56) References Cited

U.S. PATENT DOCUMENTS

| | | | | |
|---|---|---|---|---|
| 905,650 | A | 12/1908 | Clarke | |
| 1,371,533 | A | 3/1921 | Wright | |
| 1,511,738 | A | 10/1924 | Lownsbery | |
| 1,689,639 | A * | 10/1928 | Neff | B25B 13/08 81/177.2 |
| 1,793,714 | A * | 2/1931 | Newberg | B25B 13/08 81/125.1 |
| 2,652,736 | A * | 9/1953 | Kiene | B25G 1/00 16/427 |
| 2,725,773 | A * | 12/1955 | Anacker | B25B 13/04 81/177.2 |
| D328,017 | S | 7/1992 | Boele | |
| 5,425,154 | A * | 6/1995 | Edwards, Jr. | B60P 7/083 16/422 |
| 5,535,649 | A * | 7/1996 | Waggle, Jr. | B25G 1/043 81/177.2 |
| 5,832,794 | A | 11/1998 | Fowler | |
| D476,203 | S | 6/2003 | Mahan | |
| 6,845,692 | B2 * | 1/2005 | Cooper | B25G 1/043 81/177.2 |
| D598,257 | S | 8/2009 | Darby | |
| D630,481 | S | 1/2011 | Hutt | |
| 8,297,154 | B2 * | 10/2012 | Chen | B25B 13/04 81/177.1 |

(Continued)

OTHER PUBLICATIONS http://www.matcotools.com/catalog/product/WE745/WRENCH-EXTENDER/.

http://www.maxx-leverage.com/.

http://www.mueller-kueps.com/product-catalog/all-tools/uni-extender-type-1/.

*Primary Examiner* — Bryan R Muller

(74) *Attorney, Agent, or Firm* — Schmeiser, Olsen & Watts, LLP

(57) ABSTRACT

A wrench extension tool is disclosed. The wrench extension tool may be used to engage a wrench in order to increase leverage and provides multiple attachment positions in which the wrench may be engaged.

12 Claims, 5 Drawing Sheets

(56) References Cited

U.S. PATENT DOCUMENTS

| | | | | |
|---|---|---|---|---|
| 8,931,376 | B2 | 1/2015 | Humphrey | |
| 2013/0098211 | A1* | 4/2013 | Sampson, Sr. ..... | B25G 1/005<br>81/177.2 |
| 2015/0251305 | A1* | 9/2015 | Mulligan ..... | B25G 1/043<br>81/177.2 |
| 2015/0258665 | A1* | 9/2015 | East ..... | B25B 13/48<br>81/124.4 |
| 2016/0129580 | A1 | 5/2016 | Klimsza | |
| 2016/0325426 | A1 | 11/2016 | Bolivar | |

* cited by examiner

WRENCH EXTENSION TOOL

PRIORITY AND RELATED APPLICATIONS

This application is a continuation in part of and claims priority to U.S. Non-provisional patent application Ser. No. 14/545,471 filed May 8, 2015, which is hereby incorporated by reference in its entirety.

FIELD OF TECHNOLOGY

The following relates to a wrench extension tool, and more specifically to a wrench extension tool having at least one end configured to engage a wrench.

BACKGROUND

Wrenches are a common tool for a variety of professions, including mechanics, engineers, etc. Further, many individuals are familiar with and use wrenches in a variety of everyday activities, even if such wrenches are not necessary for their profession. Wrenches are often needed for maintenance and other work on machinery, such as to loosen or tighten nuts, bolts, or other rotationally threaded objects. Further, work on machinery may include work in tight spaces. The tight space may limit the user's access to the machinery and may impact the wrench chosen to do a specific job. The limited space may also prevent the user from being able to exert full force or torque onto the nut, bolt, or other object to which the force or torque is to be applied.

Typically, users must fetch another wrench or tool to combine with the original wrench for increasing the amount of torque or force applied to the wrench. While this method may assist with the loosening or tightening of frozen or seized nuts, bolts, or other objects, it is susceptible to unwanted disengagement during the application of torque or force. Disengagement between the wrenches under pressure causes injuries to the user's hands, fingers, and especially the knuckles.

Thus, a wrench extension tool for more reliable engagement with a wrench or other hand tool would be well received in the art.

BRIEF SUMMARY

A first aspect relates generally to a wrench extension tool, comprising: a tool end, wherein the tool end comprises a tool channel, a first pin attached across the tool channel, a second pin attached across the tool channel, and a front panel.

A second aspect relates generally to a wrench extension tool, comprising: a first tool end, wherein the first tool end comprises a first tool channel, a pin attached across a first surface of the first tool channel, a pin attached across a second surface of the first tool channel, and a first front panel; a second tool end, wherein the second tool end comprises a second tool channel, a pin attached across a first surface of the second tool channel, a pin attached across a second surface of the second tool channel, and a second front panel; and a body connecting the first tool end and the second tool end.

BRIEF DESCRIPTION OF THE DRAWINGS

Some of the embodiments will be described in detail, with reference to the following figures, wherein like designations denote like members, wherein.

DETAILED DESCRIPTION OF THE INVENTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

FIGS. 1-5 show a wrench extension tool 10 according to an embodiment. The wrench extension tool 10 may be made of any suitably sturdy material or combination of materials, for example it may be metal, wood, plastic, or composite. Further, the material of the wrench extension tool may include one or more coatings or treatments. In some embodiments, the wrench extension tool 10 may be comprised of steel. In further embodiments, the wrench extension tool 10 may be comprised of a steel core with a coating of nickel and/or zinc. The wrench extension tool 10 may be used in conjunction with a wrench A (shown in FIGS. 6-9). The wrench extension tool 10 may be cast, molded, forged, or otherwise formed, and may be provided with a sufficient strength to avoid deformation when large amounts of torsion or force is applied to the wrench extension tool 10 and/or wrench A. In some embodiments, the linear strength of the wrench extension tool 10 may be equal to the linear strength of the wrench A, which may be made of a material with a high level of hardness on a hardness scale recognized by those skilled in the tool industry. Embodiments of the wrench extension tool 10 may be manufactured as a one-piece, solid component, or one or more components may be welded together to form a single, sturdy wrench extension tool 10.

Figure 10A:
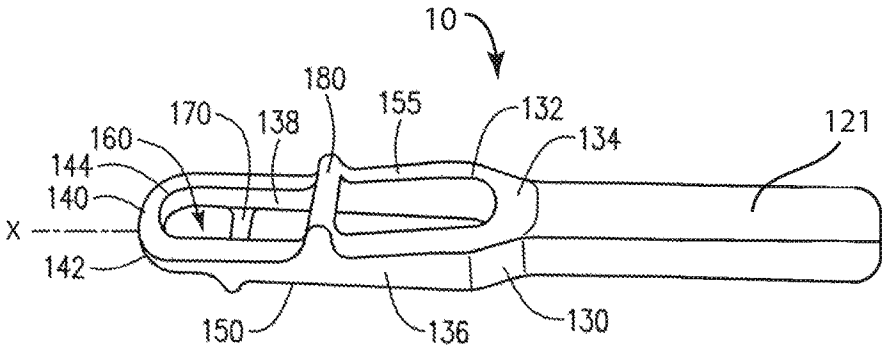
FIG. 10*a* is a side perspective view of another embodiment of a wrench extension tool.
Figure 10B:
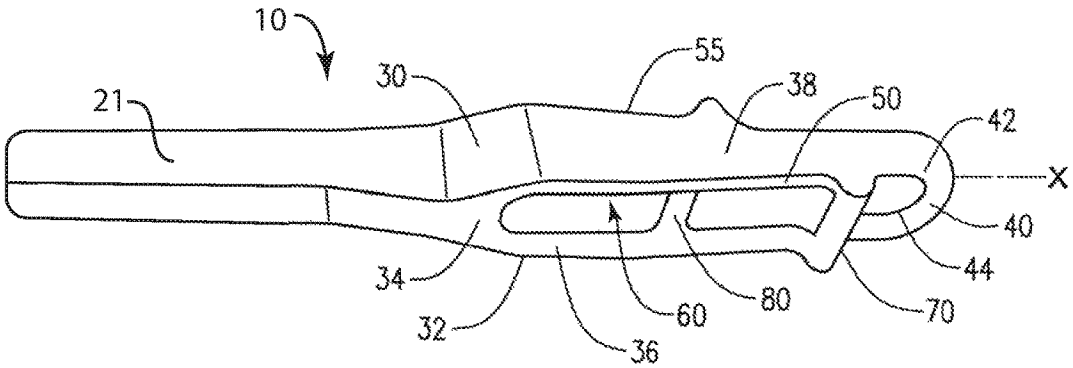
FIG. 10*b* is a side perspective view of another embodiment of a wrench extension tool.

As is depicted in the Figures, embodiments of the wrench extension tool 10 may comprise two tool ends, such as a first end 30 and a second end 130. Embodiments may also include a wrench extension tool body 20. As shown in FIGS. 10*a* and 10*b*, in some embodiments, the wrench extension tool 10 may comprise only a single tool end. For example, embodiments of the wrench extension tool may include a first tool end 30 with the opposing end forming only a handle or handle portion 21. Likewise, embodiments of the wrench extension tool 10 may include a second tool end 130, with the opposing end forming only a handle or handle portion 121. The handle or handle portion 21, 121 may be made of any suitable material. In some embodiments, the hand or handle portion 21, 121 may be of the same material or combination of materials as the wrench extension tool 10, or may be of a different material or combination of materials.

Common parts between the tool ends 30, 130 are referred to with the same final two numbers, with a leading number "1" being used for the convenience and clarity when referring to the elements of the second tool end 130 and no leading "1" when referring to the first tool end 30.

The first tool end 30 and the second tool end 130 may be constructed to engage a wrench A, as is shown in FIGS. 6-9. The wrench A may be an open-ended wrench as is depicted. The wrench A may also be a dual-ended wrench (second side not depicted). Still further, the dual-ended wrench may comprise a first end of one size and a second end of a second size. For example, many common tool sets may include a dual-ended wrench having a first end with a ½ inch open-ended wrench and a second end with a 9/16 inch open-ended wrench. The wrench A may include a wrench opening B and a wrench neck C. The wrench extension tool 10 may cooperate with additional wrenches, including a combination wrench, which may have one end being an open end wrench and the other being a box end or a socket, joint, and the like.

The first tool end 30 and the second tool end 130 may each comprise a tool channel 32, 132. The tool channel 32, 132 may comprise a rear panel 34, 134, a first side panel 36, 136, a second side panel, 38, 138, and a front panel 40, 140. The tool channel 32, 132, may comprise a first surface 50, 150 and a second surface 55, 155, wherein the first surface 50, 150 and the second surface 55, 155 form an "upper" and "lower" boundary of the tool channel 32, 132, and are separated from each other by the first side panel 36, 136 and the second side panel 38, 138. The tool channel 32, 132 may define a channel opening 60, 160, that is bounded by the rear panel 34, 134, the first side panel 36, 136, the second side panel 38, 138, and the front panel 40, 140.

Figure 4:
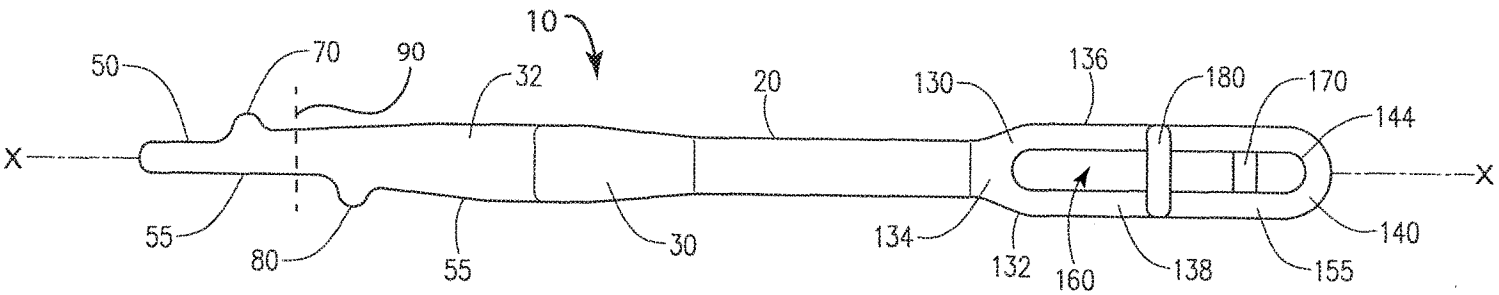
FIG. 4 is a reverse side view (respective to FIG. 3) of an embodiment of the wrench extension tool shown in FIGS. 1-3.

In some embodiments, spanning the tool channel opening 60, 160 may be a first pin 70, 170. Embodiments of the first pin 70, 170 may be a bar, a cross-bar, a cross-member, a rod, and the like. Embodiments of the first pin 70, 170 may be formed as one-piece with the wrench extension tool 10, or may be welded on after formation of the wrench extension tool 10. Embodiments of the first pin 70, 170 may be attached proximate to the front panel 40, 140 and attached on the first surface 50, 150. Also spanning the tool channel opening 60, 160 may be a second pin 80, 180. Embodiments of the second pin 80, 180 may be a bar, a cross-bar, a cross-member, a rod, and the like. Embodiments of the second pin 80, 180 may be formed as one-piece with the wrench extension tool 10, or may be welded on after formation of the wrench extension tool 10. Embodiments of the second pin 80, 180 may be attached proximate to the rear panel 34, 134 on the second surface 55, 155. Which is considered the first surface 50, 150 and which is considered the second surface 55, 155 may be reversed. In yet further embodiments, as shown in FIG. 4, the first surface 50, 150 and the second surface 55, 155 may be offset from each other by the width of the first side panel 36, 136 and the second side panel 38, 138. Offset as used in describing these elements may mean not on the same plane in relation to their positioning within the tool channel opening 60, 160. For example, the first surface 50 and second surface 55 are at different levels of an axis 90 as shown in FIG. 4. Similarly, the first surface 150 and the second surface 155 are at different levels of an axis 190 as shown in FIG. 5.

In some embodiments, the width of either the first side panel 36, 136 and the second side panel 38, 138 may not be consistent across the length of the tool ends 30, 130. An embodiment in which the width may vary across the length of the tool end 30, 130 may be seen in FIG. 4. In some embodiments, the width may vary from approximately 0.5 cm to approximately 1.5 cm. In further embodiments, the width may vary to a greater or lesser extent; the width may also exceed the numerical ranges given, which are provided only as one example.

In still further embodiments, the first surface 50, 150 and second surface 55, 155 may each be offset, i.e., not in line with the front panel 40, 140. As shown in FIGS. 4 and 5, neither the first surface 50, 150 nor the second surface 55, 155 is at the same level of the respective axes 90, 190.

Figure 5:
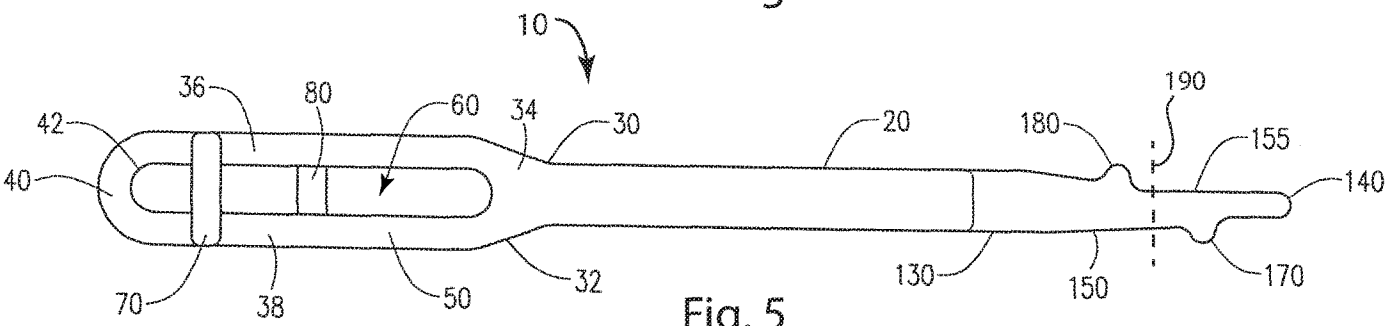
FIG. 5 is a 90 degree side view (respective to FIG. 3) of an embodiment of the wrench extension tool shown in FIGS. 1-4.

In some embodiments, the first pin 70, 170 and the second pin 80, 180 may also be offset, as is shown in FIGS. 4 and 5. The offset of the first pin 70, 170 and the second pin 80, 180 may be due to the positioning of the first surface 50, 150 and second surface 55, 155 in some embodiments. In some embodiments, offsetting the first pin 70, 170 and the second pin 80, 180 may facilitate various attachment positions as is described more fully below.

Figure 1:
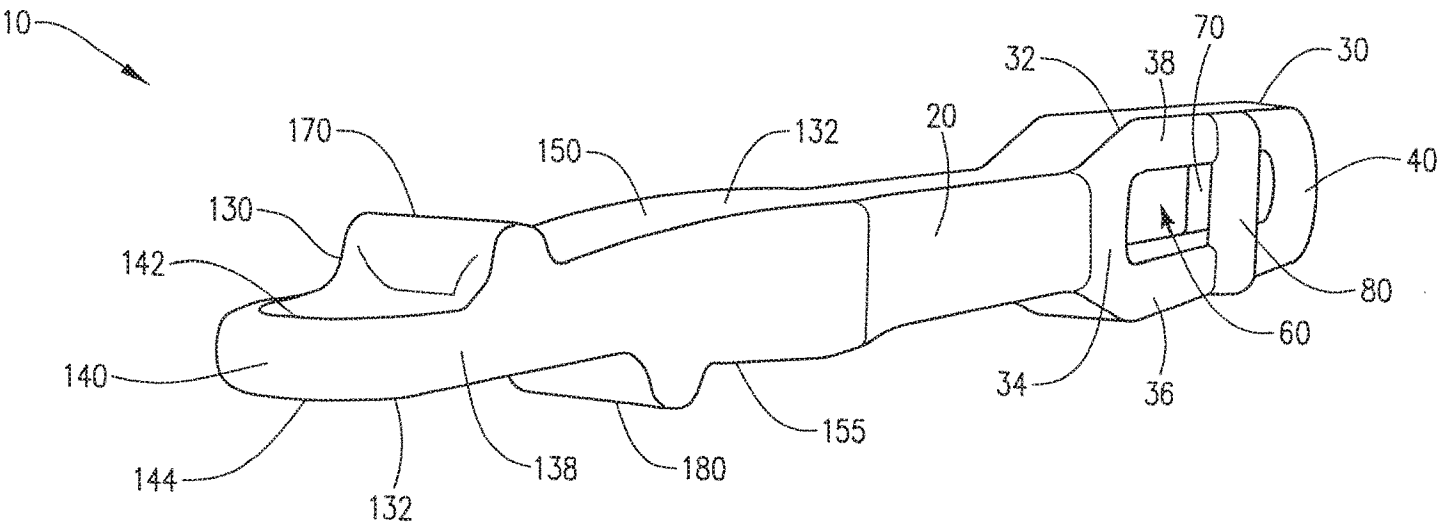
FIG. 1 is a perspective first end view of a wrench extension tool according to one embodiment.
Figure 2:
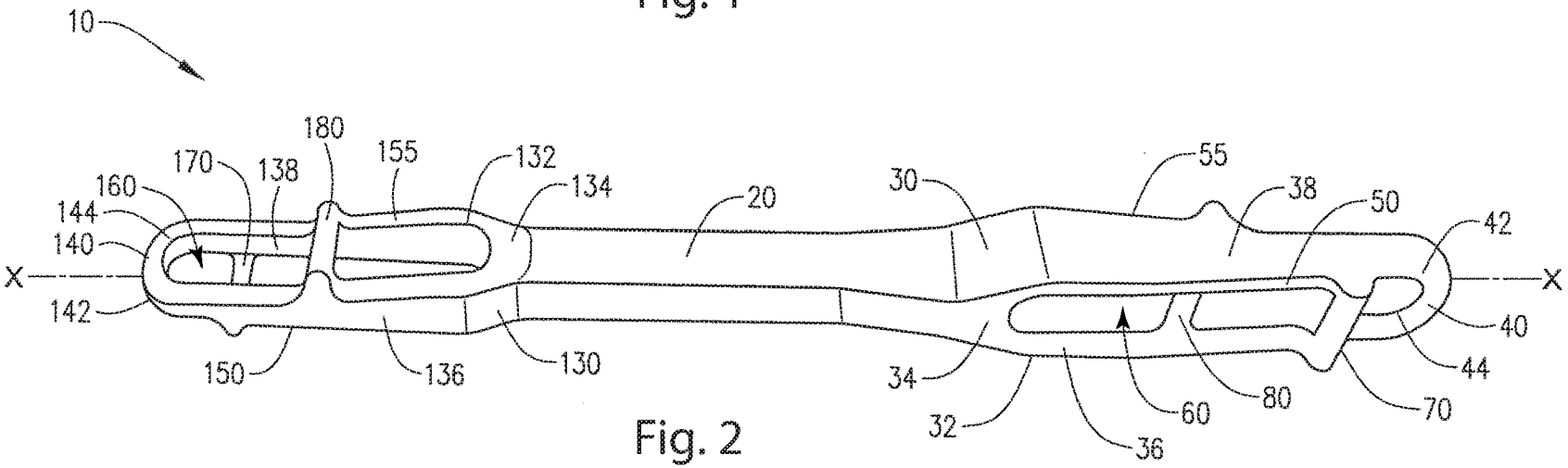
FIG. 2 is a side perspective view of an embodiment of the wrench extension tool shown in FIG. 1.
Figure 3:
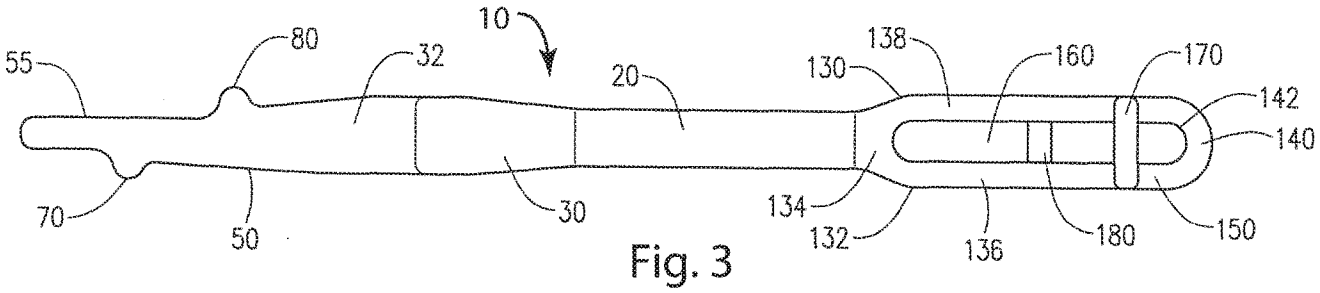
FIG. 3 is a side view of an embodiment of the wrench extension tool shown in FIGS. 1-2.

In some embodiments, the first tool end 30 and the second tool end 130 may be offset approximately 90 degrees laterally from one another along the longitudinal axis X of the wrench extension tool 10 as shown in FIGS. 2 and 4. In some embodiments, the first tool end 30 may be a different size than the second tool end 130. In yet further embodiments, each of the two tool ends 30, 130 may be sized to correspond to the size of the alternative ends of a dual open end wrench for which the extension tool 10 is designated to fit.

In some embodiments, the first pin 70, 170 may be provided with a rounded profile, as shown in the cross sectional views of FIGS. 6-9. Similarly, in some embodiments, the second pin 80, 180 may also be provided with a rounded profile. Additionally, in further embodiments, the front panel 40, 140 may also be provided with a rounded profile. In yet more embodiments, each of the first pin, 70, 170, the second pin 80, 180, and the front panel 40, 140 may be provided with a rounded profile. The inclusion of a rounded profile on one or more of these components may facilitate engagement of multiple size wrenches by the wrench extension tool 10.

In some embodiments, the tool channel 32, 132 and the tool channel opening 60, 160 may be dimensionally proportional to a corresponding open end wrench size in metric or standard sizes.

In some embodiments, the provision and orientation of the first pin 70, 170 and second pin 80, 180 spanning a common channel 32, 132, respectively, may provide for at least four selections of attachment positions between the wrench extension tool 10 and wrench A. The attachment position used may be determined by the user. FIGS. 6-9 depict cross sectional representations of a variety of attachment positions between the wrench extension tool 10 and the wrench A.

While FIGS. 6-9 depict an engagement between wrench A and a second tool end 130 of the wrench extension tool 10 according to embodiments in which the wrench extension tool 10 has two tool ends 30, 130, it should be understood that the first tool end 30 could also be used to engage the wrench A, depending upon the dimension of the tool end and the wrench A. Thus, for the following descriptions, the attachment positions (and related description) disclosed for the second tool end 130 may apply to the first tool end 30 (removing the leading numeral "1" from the element numbers as is described).

Figure 6:
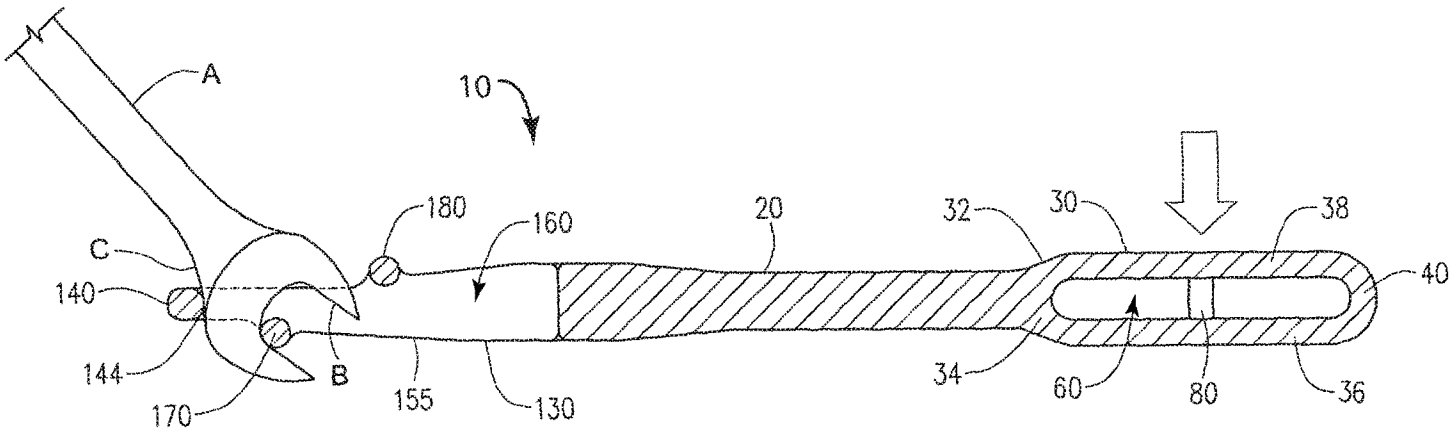
FIG. 6 is a cross sectional view of an embodiment of the extension tool shown in FIGS. 1-5 engaging an open end of a wrench according to one embodiment.

FIG. 6 depicts a first attachment position according to an embodiment. In the first engagement position, the wrench extension tool 10 engages the wrench A when the wrench A is inserted within the tool channel opening 160 from the side opposite the first pin 170. In this attachment position, the wrench opening B may contact the first pin 170 and the wrench neck C may be forced against the front panel 140 of the tool channel 132. Similarly, this attachment position, in an embodiment, may be achieved on the first tool end 30 when the wrench A is inserted within the tool channel opening 60 from the side opposite the first pin 70. In this attachment position, wrench opening B may contact the first pin 70 and the wrench neck C may be forced against the front panel 40 of the tool channel 32.

Figure 7:
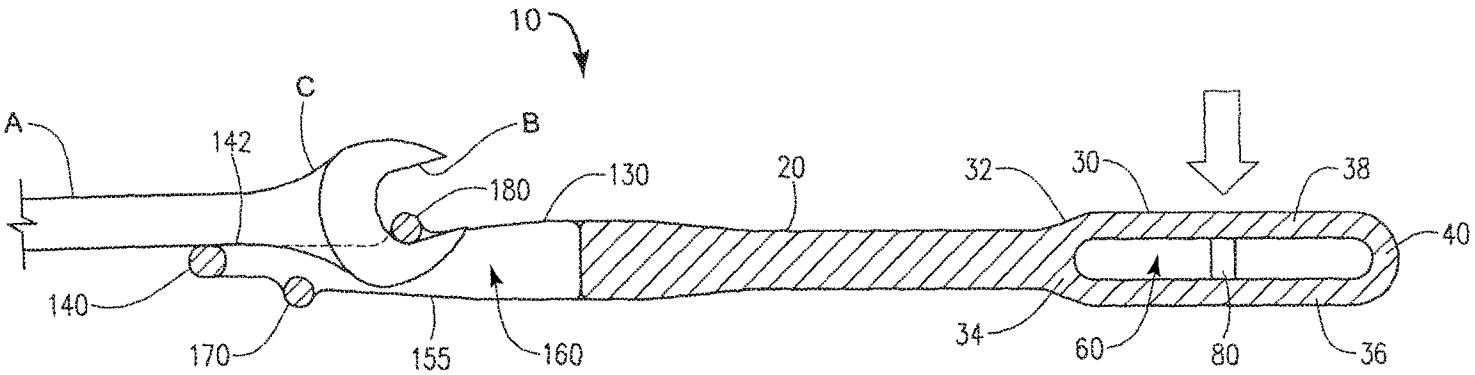
FIG. 7 is a cross sectional view of an embodiment of the extension tool shown in FIGS. 1-6 engaging an open end of a wrench according to one embodiment.

FIG. 7 depicts a second attachment position according to an embodiment. The second attachment position shows the wrench extension tool 10 engaging the wrench A that is inserted within the tool channel opening 160 from the side opposite the first pin 170. The wrench opening B may engage the second pin 180 with the wrench neck C abutting the front panel 140 of the tool channel opening 160, thus positioning the wrench and extension tool substantially in a straight line. Similarly, this attachment position may be achieved, in an embodiment, on the first tool end 30 when the wrench A is inserted within the tool channel opening 60. In this attachment position, wrench opening B may contact the second pin 80 and the wrench neck C may be forced against the front panel 40 the tool channel 32.

Figure 8:
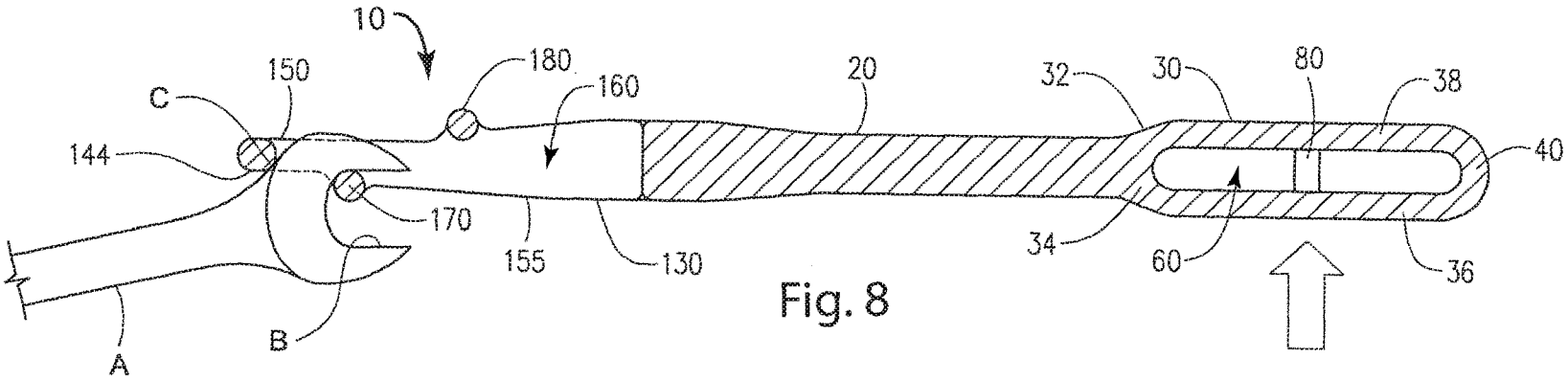
FIG. 8 is a cross sectional view of an embodiment of the extension tool shown in FIGS. 1-7 engaging an open end of a wrench according to one embodiment.

FIG. 8 depicts a third attachment position according to an embodiment. The third attachment position shows the wrench A inserted within the tool channel opening 160 from the side opposite the second pin 180. The wrench opening B may engage the first pin 170 and the wrench neck C may abut the front panel 140 of the tool channel 132, thus positioning the wrench A and the wrench extension tool 10 at a shallow angle in relation to each other. Similarly, this attachment position may be achieved, in an embodiment, on the first tool end 30 when the wrench A is inserted within the tool channel opening 60. In this attachment position, wrench opening B may contact the first pin 70 and the wrench neck C may abut the front panel 40 of the tool channel 132.

Figure 9:
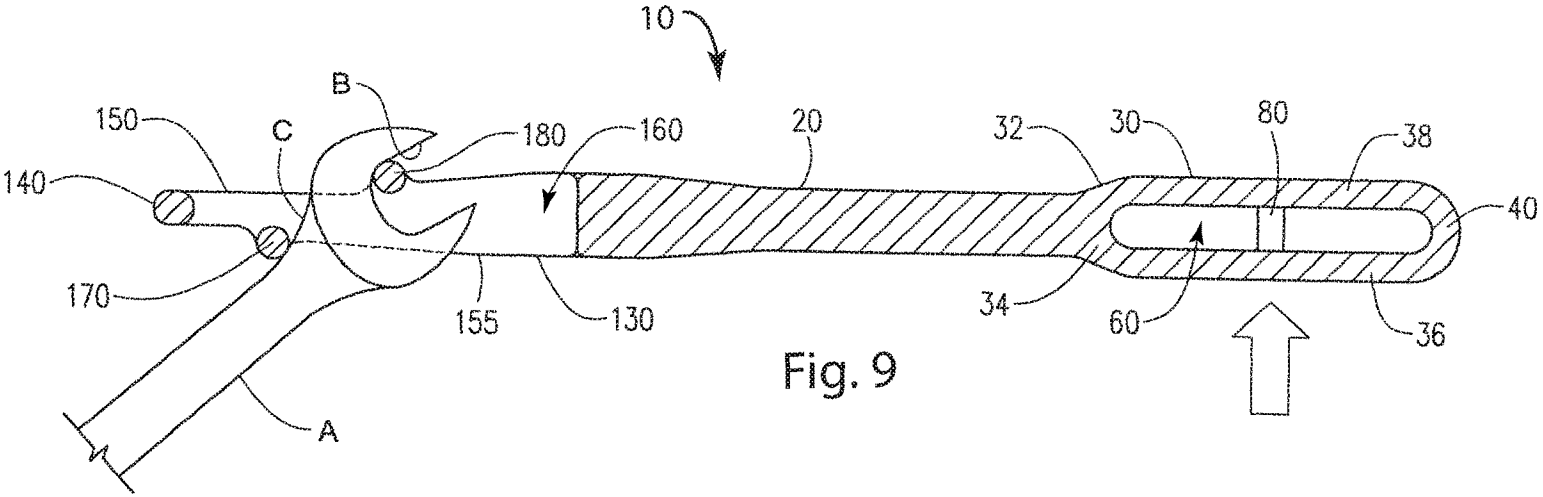
FIG. 9 is a cross sectional view of an embodiment of the extension tool shown in FIGS. 1-8 engaging an open end of a wrench according to one embodiment.

FIG. 9 depicts a fourth attachment position according to an embodiment. In this embodiment, the wrench extension tool 110 may engage the wrench opening B of the wrench A when the wrench A is inserted within the tool channel opening 160 from the side opposite the second pin 180. The wrench opening B may engage the second pin 180 and the wrench neck C may engage the first pin 170 of the tool channel 132, thus positioning the wrench and extension tool 110 at a steeper angle than in attachment position three. Similarly, this attachment position may be achieved, in an embodiment, on the first tool end 30 when the wrench A is inserted within the tool channel opening 60. In this attachment position, wrench opening B may contact the second pin 80 and the wrench neck C may abut the first pin 70 of the tool channel 132.

The selection of which attachment position to use may be made by the user. The user may make this selection based on the position of the wrench and the accessibility of the user to the object to be acted on by the wrench. The confines of the space in which the wrench is to be used may also be considered.

With respect to FIGS. 6-9, it should be understood that force should be applied to the wrench extension tool 10 as shown by the directional arrows included in the figures.

In some embodiments, both the first tool end 30 and the second tool end 130 may be greater in circumference larger than the body 20 which connects them. This greater circumference of each tool ends 30, 130 may provide an enhanced hand grip location for the wrench extension tool 10 than would be provided by a straight handle when the first tool end is being used on a wrench and the second tool end used as a hand grip location or vice versa, which is an ergonomic benefit known by those skilled in the art of hand tools.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A wrench extension tool, comprising:

a tool end configured to engage the head of an open-end wrench, the head of the open-end wrench having a wrench opening and a wrench neck, wherein the tool end comprises a tool channel, a right side panel, a left side panel, a front panel and rear panel, an upper edge of the right side panel, left side panel, front panel and rear panel forming an upper surface with an upper surface tool channel opening, a lower edge of the right side panel, left side panel, front panel and rear panel forming a lower surface with a lower tool channel opening and the tool channel defined by the inner surfaces of the right side panel, left side panel, front panel and rear panel;

a first pin attached to said upper surface across said upper tool channel opening of the tool end, wherein said first pin is attached proximate to said respective front panel; and a second pin attached across said lower tool channel opening of the tool end, wherein said second pin is attached to said lower surface closer to the respective rear panel than the respective first pin;

further wherein, when the tool end engages the head of the open-end wrench, the open-end wrench is capable of being positioned in any one of the following positions:

a) a first position wherein the wrench opening contacts the first pin and the wrench neck contacts the lower edge of the front panel, b) a second position wherein the wrench opening contacts the second pin and the wrench neck contacts the front panel, c) a third position wherein the wrench opening contacts the first pin and the wrench neck contacts the upper surface of the front panel, and d) a fourth position wherein the wrench opening contacts the second pin and the wrench neck contacts the first pin.

2. The wrench extension tool of claim 1, wherein at least one of the first pin, the second pin, and the front panel have a rounded profile.

3. The wrench extension tool of claim 2, further wherein the first pin, the second pin, and the front panel each have a rounded profile.

4. The wrench extension tool of claim 1, further comprising a handle.

5. The wrench extension tool of claim 4, wherein the handle is located at the distal end of the wrench extension tool with respect to the front panel.

6. A wrench extension tool, comprising:

a tool end configured to engage the head of an open-end wrench, the open-end wrench including a wrench opening and a wrench neck;

wherein the tool end comprises a tool channel, a right side panel, a left side panel, a front panel and rear panel;

further wherein the tool channel is defined by the inner surfaces of the right side panel, left side panel, front panel and rear panel, and has a center axis running from a center of the front panel to the center of the rear panel;

a first pin attached across said tool channel of the tool end, wherein said first pin is attached proximate to said respective front panel;

a second pin attached across said tool channel of the tool end, wherein said second pin is attached closer to the respective rear panel than the respective first pin; and wherein the first and second pins are each offset from the center axis running from the center of the front panel to the center of the rear panel such that the first pin is positioned above the axis and the second pin is positioned below the axis;

further wherein, when the tool end engages the head of the open-end wrench, the open-end wrench is capable of being positioned in any one of the following positions:

a) a first position wherein the wrench opening contacts the first pin, the wrench neck contacts the front panel, and the wrench extends substantially below the axis, b) a second position wherein the wrench opening contacts the second pin and the wrench neck contacts the front panel, c) a third position wherein the wrench opening contacts the first pin, the wrench neck contacts the front panel, and the wrench extends substantially above the axis, d) a fourth position wherein the wrench opening contacts the second pin and the wrench neck contacts the first pin.

7. The wrench extension tool of claim 6, wherein a portion of both the first and second pins extends outside the tool channel.

8. The wrench extension tool of claim 6, further comprising a handle, wherein the handle is attached to the tool end at a distal location from the front panel.

9. A method of increasing torque applied to a wrench, the method comprising:

providing an open-end wrench having a wrench opening and a wrench neck;

providing a wrench extension tool, wherein:

the wrench extension tool includes a tool end configured to engage the head of an open-end wrench, the tool end comprising a right side panel, a left side panel, a front panel and rear panel, an upper edge of the right side panel, left side panel, front panel and rear panel forming an upper surface with an upper surface tool channel opening, a lower edge of the right side panel, left side panel, front panel and rear panel forming a lower surface with a lower tool channel opening and the tool channel defined by the inner surfaces of the right side panel, left side panel, front panel and rear panel; a first pin attached at said upper surface across said upper tool channel opening of the tool end, wherein said first pin is attached proximate to said respective front panel; a second pin attached at said lower tool channel opening of the tool end, wherein said second pin is attached to said lower surface closer to the respective rear panel than the respective first pin; and inserting the wrench into the tool channel, wherein when the wrench is inserted into the tool channel the wrench is capable of being positioned in any one of the following positions:

a) a first position wherein the wrench opening contacts the first pin and the wrench neck contacts the lower edge of the front panel, b) a second position wherein the wrench opening contacts the second pin and the wrench neck contacts the front panel, c) a third position wherein the wrench opening contacts the first pin and the wrench neck contacts the upper surface of the front panel, and d) a fourth position wherein the wrench opening contacts the second pin and the wrench neck contacts the first pin; and applying a force to the wrench extension tool which is translated into torque applied to the wrench.

10. The method of claim 9, wherein at least one of the first pin, the second pin, and the front panel have a rounded profile.

11. The method of claim 9, wherein the wrench extension tool further comprises a handle located opposite the tool end.

12. The method of claim 9, wherein the wrench extension tool further comprises a second tool end opposite the tool end.

* * * * *